US008766893B2

(12) United States Patent
Wang

(10) Patent No.: US 8,766,893 B2
(45) Date of Patent: Jul. 1, 2014

(54) METHOD FOR COMPENSATING FOR POOR UNIFORMITY OF LIQUID CRYSTAL DISPLAY HAVING NON-UNIFORM BACKLIGHT AND DISPLAY THAT EXHIBITS NON-UNIFORMITY COMPENSATING FUNCTION

(75) Inventor: Tsung-I Wang, Tao-Yuan Hsien (TW)

(73) Assignee: Dynascan Technology Corp., Tao-Yuan Hsien (TW)

( * ) Notice: Subject to any disclaimer, the term of this patent is extended or adjusted under 35 U.S.C. 154(b) by 1081 days.

(21) Appl. No.: 12/610,269

(22) Filed: Oct. 30, 2009

(65) Prior Publication Data

US 2010/0110098 A1 May 6, 2010

(30) Foreign Application Priority Data

Oct. 31, 2008 (TW) ..... 97142271 A

(51) Int. Cl.
*G09G 3/36* (2006.01)

(52) U.S. Cl.
USPC ..... 345/88; 345/87; 345/102; 345/690

(58) Field of Classification Search
USPC ..... 345/87–104, 204–215, 690–699
See application file for complete search history.

(56) References Cited

U.S. PATENT DOCUMENTS

| | | | | |
|---|---|---|---|---|
| 6,243,059 | B1 * | 6/2001 | Greene et al. | 345/88 |
| 6,271,825 | B1 * | 8/2001 | Greene et al. | 345/694 |
| 7,737,930 | B2 * | 6/2010 | Inuzuka et al. | 345/87 |
| 7,956,875 | B2 * | 6/2011 | Inuzuka et al. | 345/690 |
| 2005/0073495 | A1 * | 4/2005 | Harbers et al. | 345/102 |
| 2006/0125771 | A1 * | 6/2006 | Inuzuka et al. | 345/102 |
| 2006/0262078 | A1 * | 11/2006 | Inuzuka et al. | 345/102 |
| 2007/0159448 | A1 * | 7/2007 | Inuzuka et al. | 345/102 |
| 2007/0236447 | A1 * | 10/2007 | Lee et al. | 345/102 |
| 2008/0122832 | A1 * | 5/2008 | Chen et al. | 345/214 |
| 2008/0150880 | A1 * | 6/2008 | Inuzuka et al. | 345/102 |
| 2008/0151144 | A1 * | 6/2008 | Hirose et al. | 349/69 |
| 2010/0289833 | A1 * | 11/2010 | Budzelaar et al. | 345/690 |

FOREIGN PATENT DOCUMENTS

| | | |
|---|---|---|
| CN | 1721943 | 1/2006 |
| CN | 1746743 | 3/2006 |
| CN | 1842923 | 10/2006 |
| CN | 100360999 | 1/2008 |

OTHER PUBLICATIONS

Abstract of CN1721943, Jan. 18, 2006 espacenet database—Worldwide.

(Continued)

*Primary Examiner* — Gene W Lee

(57) ABSTRACT

The invention relates to a method for compensating for poor uniformity of a liquid crystal display having a non-uniform backlight. By virtue of selecting a standard color that all cells can achieve to serve as a virtually primary color, the invention measures to give the relationship between the tri-stimulus values of the virtually primary color and those presented by the respective cells and records the resultant values to serve as compensation data. During operation of a display, the input image data are computed based on the compensation data for respective cells in accordance with the cell locations and converted into compensated image signals. As such, all of the cells are able to present the same chromaticity and brightness upon receiving the same image signal, thereby performing uniform chromaticity and brightness across the entire display.

3 Claims, 12 Drawing Sheets

(56) References Cited

OTHER PUBLICATIONS

Abstract of CN1746743, Mar. 15, 2006, espacenet database—Worldwide.

Abstract of CN1842923, Oct. 4, 2006, espacenet database—Worldwide.

Abstract of CN100360999, Jan. 9, 2008, espacenet database—Worldwide.

* cited by examiner

METHOD FOR COMPENSATING FOR POOR UNIFORMITY OF LIQUID CRYSTAL DISPLAY HAVING NON-UNIFORM BACKLIGHT AND DISPLAY THAT EXHIBITS NON-UNIFORMITY COMPENSATING FUNCTION

FIELD OF THE INVENTION

The present invention relates to a method for compensating for poor uniformity of a display, and more particularly, to a method for compensating for poor uniformity of a liquid crystal display having a non-uniform backlight and a display that exhibits a non-uniformity compensating function.

DESCRIPTION OF THE RELATED ART

A liquid crystal display (LCD) mainly includes a backlight at its rear side and a liquid crystal module at its front side. An image of the LCD is displayed by allowing the light emitted from the backlight to pass through several color filters disposed in front of the backlight to thereby generate three primary colors of red, green and blue at corresponding liquid-crystal valves disposed in the liquid crystal module, followed by using electrical signals to control the voltage between the electrodes disposed at two sides of respective liquid-crystal valves to thereby alter the light transmission ratio across the liquid crystals interposed between the electrodes. For illustrative purpose, a liquid-crystal valve is called herein as a sub-cell. The red, green and blue light beams passing through the respective three sub-cells are mixed to constitute a color pixel. An entire picture is a combination of the brightness and chromaticity presented at respective pixel locations.

The colors of a color-filter are generated taking advantage of the pigment transmittance principle. A typical transmittance spectrum T(λ) of a color filter for three primary colors is shown in FIG. 1, where the letter R denotes the transmittance spectrum of red light, with G denoting the green light transmittance spectrum and B denoting the blue light transmittance spectrum, indicating that the color filter shows an excellent color reproductivity and demonstrates a uniform transmittance across the entire filter. As an array of three color-filters of red, green and blue are normally employed in an LCD to constitute color pixels at respective cell locations, a white-light backlight has to be used in the LCD.

On the other hand, with the so-called "local color dimming control" technology developed in recent years, it has become possible to modulate the brightness of the respective primary colors of a backlight. Light emitting diodes (LEDs) are continuously improved in luminous efficacy, while the manufacture cost thereof keeps decreasing. Meanwhile, the adoption of LEDs as a backlight source is beneficial to raising the contrast ratio of an LCD by using the local dimming control technology and, in the case where RGB LEDs are used in an LCD, advantageously enables the color gamut of the LCD to exceed the NTSC Standard. Other advantages include: preventing moving blur, reducing power consumption, facilitating slim designs of products and being environmental friendly. All of these factors lead to the growing market adoption of LEDs as the backlight source of an LCD.

There are two ways of using LEDs as a light source, one integrating a blue light LED with a phosphor powder wherein the phosphor powder is excited to convert the blue light into a light having a longer wavelength so as to synthesize white light for illumination; the other directly combining RGB LED chips to constitute a white light LED. However, regardless of the types of white light LEDs, the brightness and chromaticity values always vary from one LED die to another. For example, in the case of a white light LED integrating a blue light chip with a phosphor powder, the brightness and chromaticity of white light emitted from the LED will be affected by the factors such as the wavelength of the blue light and the composition and mixture condition of the phosphor powder. As such, in the same batch of products, some LEDs may emit yellowish white light while the others produce bluish white light, causing the light emitted from the LED products to migrate within a range between 0.26 and 0.36 as defined by the Chromaticity Coordinates.

Similarly, in the case of a white light LED device that combines RGB LED chips, the mixed white light emitted therefrom varies as measured by the Chromaticity Coordinates system due to the diversity in chromaticity of respective LED dies. In order to deal with this drawback, R.O.C. Patent Publication No. 480879 assigned to the present applicant, entitled "Method to Compensate for the Color Non-Uniformity of Color Display," has proposed a process for unifying the brightness and chromaticity at respective pixels by adjusting the brightness distribution of individual RGB dies.

As the brightness and chromaticity vary from one light source to another, the backlight may still fail to provide uniform emanating light even if a diffuser is placed in the light path. It is assumed that the i-th cell in a liquid crystal module has a primary backlight source of LEDi and the i+1-th cell has a primary backlight source of LEDi+1, wherein LEDi generates a reddish light and the LEDi+1 emits a bluish light. For illustrative purpose, the image signals described herein have an intensity of between 0 and 1, in which 0 represents that a light valve is in a fully closed state and 1 indicates that the light valve is set in a fully open state. In a full raster white mode, the image signal (Sr, Sg, Sb)i transmitted to each cell is set to have a magnitude of (1.0, 1.0, 1.0), indicating that the light valves of the red, green and blue sub-cells are all maintained in their fully open state. As the LEDi generates a reddish light, the corresponding cell presents a reddish pixel i. And the bluish LEDi+1 leads to a bluish pixel i+1. Hence, the overall brightness and chromaticity of the image are rendered non-uniform.

According to the current practice, a conventional LED drive circuit design with a minimum manufacture cost as shown in FIG. 2 is available, wherein a drive voltage VDD higher than a total forward bias voltage of the LEDs connected in series is supplied to drive multiple LEDs in series (regardless of whether phosphor-based white LEDs or RGB LEDs are used). In this embodiment, the drive current Is is a constant current source whose duty-cycle ratio is modulated to have a waveform of either 0 or 1 by a control circuit that outputs PWM (pulse-width modulation) signals of different frequencies, such that the series of LEDs are powered in a synchronized manner to emit light with a controlled brightness.

However, if a conventional LED drive circuit is used as described above, the effective current for lighting the series of LEDs would be limited to a value ranged between 0 and 1. Thus, the conventional circuit design, while having an advantage in reducing manufacture cost, appears unable to adjust the chromaticity and brightness of individual LEDs in the same series. Once an individual LED is not uniform in chromaticity and brightness with the rest of LEDs in the same series, the non-uniformity may not be compensated for by using the conventional technology owned by the applicant, causing non-uniform chromaticity and brightness among pixels on an LCD screen.

To date, the only way to ameliorate the non-uniformity described above is to perform LED sorting in terms of chromaticity and brightness. Since the human eye is very perceptive of small changes in chromaticity and brightness, LEDs have to be sorted so delicately that human eye will not notice any difference in chromaticity and brightness. In this case, backlight LEDs that emit light by exiting phosphors using blue light should be sorted into at least 20 chromaticity bins and at least 5 bins for brightness variation, which means more than 100 LED bins in totality if taking both characters in account. As to the white-light LEDs made up with R, G and B dies, they have to be sorted by chromaticity and brightness with approximately 30 bins per each primary color. That is, approximately one hundred bins for three primary colors.

The large number of bins of backlight dies and LED elements causes considerable difficulty in inventory management, which in turn increases the manufacture cost. Worse still, even if an individual LCD device is by itself uniform in brightness and chromaticity, two LCD devices with the same brand name may still show different chromaticity and brightness due to utilizing different bins of backlight LEDs. This does not only place a great load on quality control, but causes consumers' skepticism towards product quality if the two LCD devices are displayed side-by-side in a store.

Therefore, there exists a need for technical means for ensuring uniform chromaticity and brightness in individual LCD devices and among different LCD devices. Especially, the need can be fulfilled without using highly sorted LEDs as a backlight source, thereby elevating manufacturing flexibility and reducing sorting costs. The present invention provides the best solution in response to the need.

SUMMARY OF THE INVENTION

Accordingly, an object of the present invention is to provide a method for compensating for poor uniformity of a liquid crystal display having a non-uniform backlight, which ensures uniform chromaticity and brightness in individual LCD devices.

Another object of the invention is to provide a method for compensating for poor uniformity of a liquid crystal display having a non-uniform backlight, which ensures the same levels of chromaticity and brightness displayed in different LCD devices, thereby maintaining quality of products at the same quality level.

It is still another object of the invention to provide a method for compensating for poor uniformity of a liquid crystal display having a non-uniform backlight, which can be carried out using roughly sorted or even unsorted LED dies, thereby broadening the range of materials that could be used in the invention.

It is still another object of the invention to provide a liquid crystal display that is capable of ensuring uniform chromaticity and brightness across a displayed picture, even being provided with a backlight which is non-uniform in brightness and chromaticity.

It is still another object of the invention to provide a liquid crystal display provided with a backlight which is non-uniform in brightness and chromaticity, which is capable of providing uniform chromaticity and brightness across a displayed picture, thereby broadening the range of materials that could be used in the invention and reducing the manufacture cost.

The present invention therefore provides a method for compensating for poor uniformity of a liquid crystal display having a non-uniform backlight. The display comprises a non-uniform backlight; a liquid crystal display module disposed at a light exit side of the backlight and including a plurality of cells with adjustable light transmission ratios for displaying a picture made up of pixels, in which the cells are divided into a plurality of adjustment regions; a control device for controlling the respective light transmission ratios of the respective cells; and a memory device for storing compensation data which enable unification of brightness and chromaticity distribution of lights passing through the respective adjustment regions based on the brightness and chromaticity distribution of lights received by the corresponding respective adjustment regions upon receiving illumination from the backlight. The method comprises the steps of: a) obtaining image data of multiple image signals from an image source, with the image signals governing the respective light transmission ratios of the respective cells; b) computing the image signals of the image data in a weighted manner based upon the compensation data in accordance with the corresponding adjustment regions, thereby giving compensated image data that include respective compensated image signals for the respective corresponding cells; and c) determining the respective light transmission ratios of the respective cells in the liquid crystal module according to the compensated image signals.

The present invention further provides a liquid crystal display having a non-uniform backlight, comprising: a non-uniform backlight; a liquid crystal display module disposed at a light exit side of the backlight and including a plurality of cells with adjustable light transmission ratios for displaying a picture made up of pixels, in which each of the cells having a plurality of sub-cells, and in which the cells are divided into a plurality of adjustment regions; a memory device for storing compensation data which enable unification of brightness and chromaticity distribution of lights passing through the respective adjustment regions based on the brightness and chromaticity distribution of lights received by the corresponding respective adjustment regions upon receiving illumination from the backlight; and a control device for controlling the respective light transmission ratios of the respective cells, and for computing image signals of image data in a weighted manner, which are obtained from an image source and govern the respective light transmission ratios of the respective cells, based upon the compensation data in accordance with the corresponding adjustment regions, thereby determining the respective light transmission ratios of the respective cells in the liquid crystal module, such that when one of the image signals is to instruct a sub-cell of a cell corresponding to the image signal to permit light transmission therethrough, at least one of the rest sub-cells of the cell will permit light transmission therethrough in response to receipt of a compensated image signal.

By virtue of defining a virtually primary color, the invention measures the differences between the tri-stimulus values of the virtually primary color and the tri-stimulus values presented by respective adjustment regions in response to receipt of illumination from a non-uniform backlight and records the resultant values to serve as compensation data. Afterwards, when receiving image data from an image source, the invention converts original image signals into compensated image signals based on the compensation data for respective cells. The invention does not only ensure uniform chromaticity and brightness in individual LCD devices but also ensures uniform chromaticity and brightness among different LCD devices, thereby maintaining quality of products at the same quality level. Especially, the invention can be carried out using roughly sorted or even unsorted LED dies, thereby broadening the range of materials that could be used in the invention and reducing the manufacture cost.

Therefore, in light of the invention disclosed herein, the liquid crystal display according to the invention, even being provided with a backlight which is non-uniform in brightness and chromaticity, can still ensure uniform chromaticity and brightness across a displayed picture. The liquid crystal display according to the invention further broadens the range of materials that could be used in the invention and reduces the manufacture cost.

BRIEF DESCRIPTION OF THE DRAWINGS

The above and other objects, features and effects of the invention will become apparent with reference to the following description of the preferred embodiments taken in conjunction with the accompanying drawings, in which.

DETAILED DESCRIPTION OF THE INVENTION

The backlight described herein may be in the form of a backlight source composed of LED1, LED2, . . . LEDn, or may be made of a combination of cold cathode fluorescent lamps (CCFL) and LEDs. The LEDs described herein may by way of example be a LED module mounted with R, G and B dies, white light LEDs (such as the phosphor-based white light LEDs with blue light chips) or a combination of white light LEDs and RGB LEDs.

Three primary colors presented at each cell location are individually controlled by adjusting the light transmission ratios of respective sub-cells using an image signal ($S_r$, $S_g$, $S_b$), such that the lights passing through the respective sub-cells are combined to constitute a point light source substantially composed of three primary colors. As described above, even if a uniform color filter is provided onto the backlight, the three primary colors still cannot be uniformly presented at the respective pixel locations in terms of brightness and chromaticity, due to the uneven brightness and chromaticity across the backlight source. Furthermore, the light beams passing through the three sub-cells are not purely in the form of a single primary color, respectively. Therefore, the basic principle of the invention is to regard the red, green and blue sub-cells in a single cell as independent light sources for generating three primary colors.

In order to unify the brightness and chromaticity of respective cells in a display, the invention initially selects a "virtually primary color" as a standard based on the various levels of chromaticity and brightness presented at the respective cells. The invention further takes a single cell as a unit and converts an original image signal $(S_r, S_g, S_b)_i$ to be input into the cell to a signal $(S_r', S_g', S_b')_i$, such that the red, green and blue sub-cells of the cell present colors in a weighted sum manner upon receiving illumination from a backlight source. As such, the tri-stimulus values of the mixed light presented by the red (R), green (G) and blue (B) sub-cells at a cell location i are rendered substantially equal to the tri-stimulus values of the virtually primary color as denoted in the Chromaticity Diagram. Accordingly, the color appearance is rendered uniform over the entire picture shown in a single display, and even all of the displays produced from a production line can present the same chromaticity and brightness.

Figure 3:
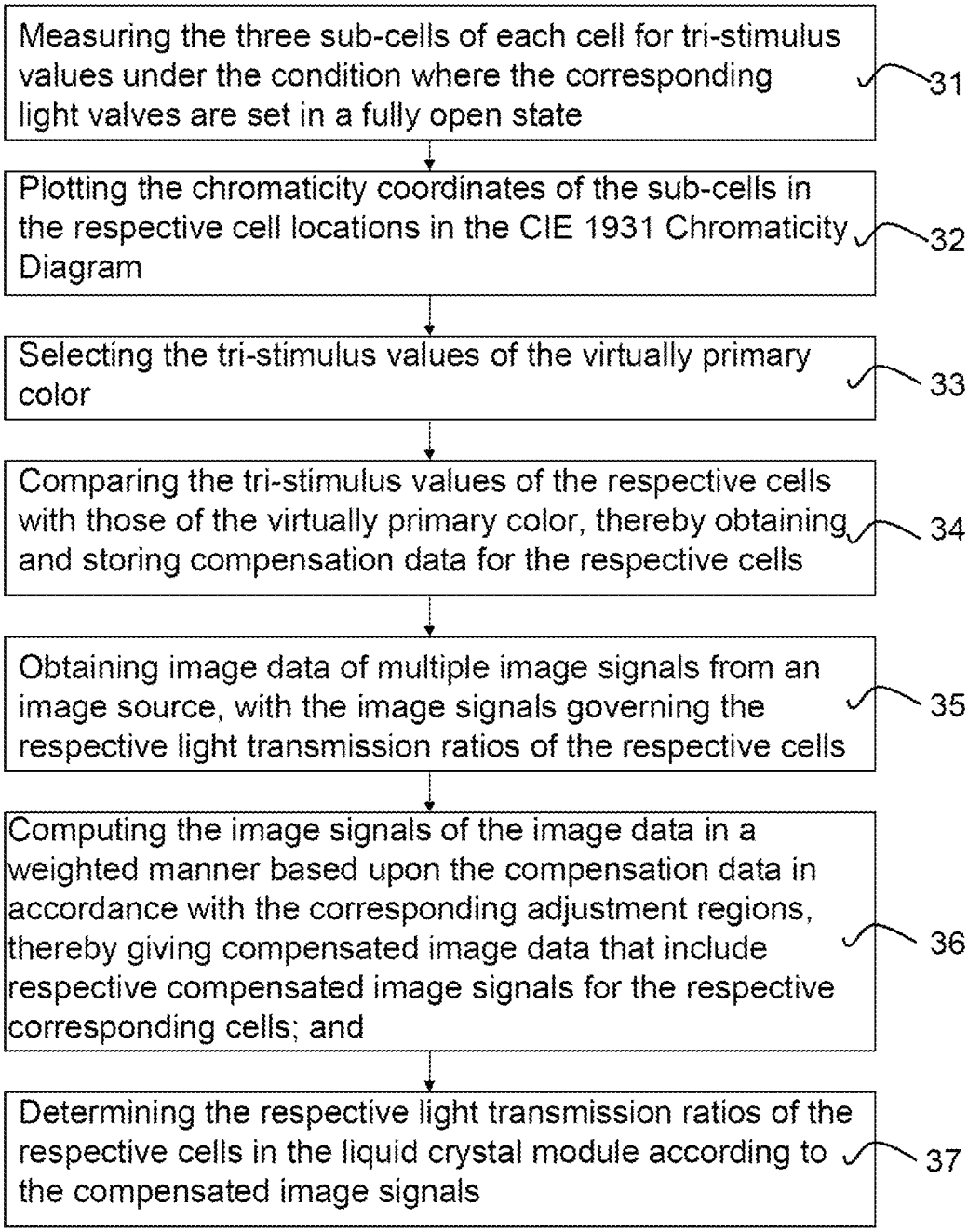
FIG. 3 is a flow chart illustrating the first preferred embodiment according to the invention.
Figure 4:
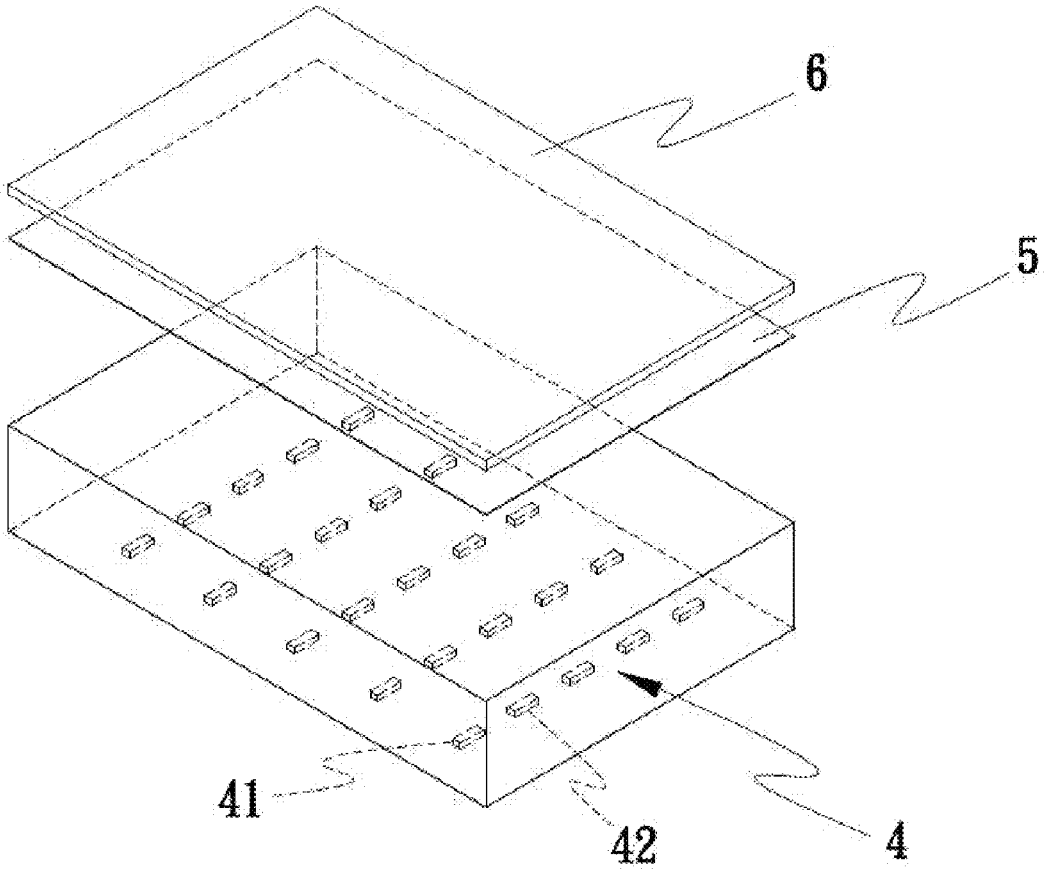
FIG. 4 is an exploded schematic diagram illustrating a liquid crystal display according to the first preferred embodiment of the invention.
Figure 5:
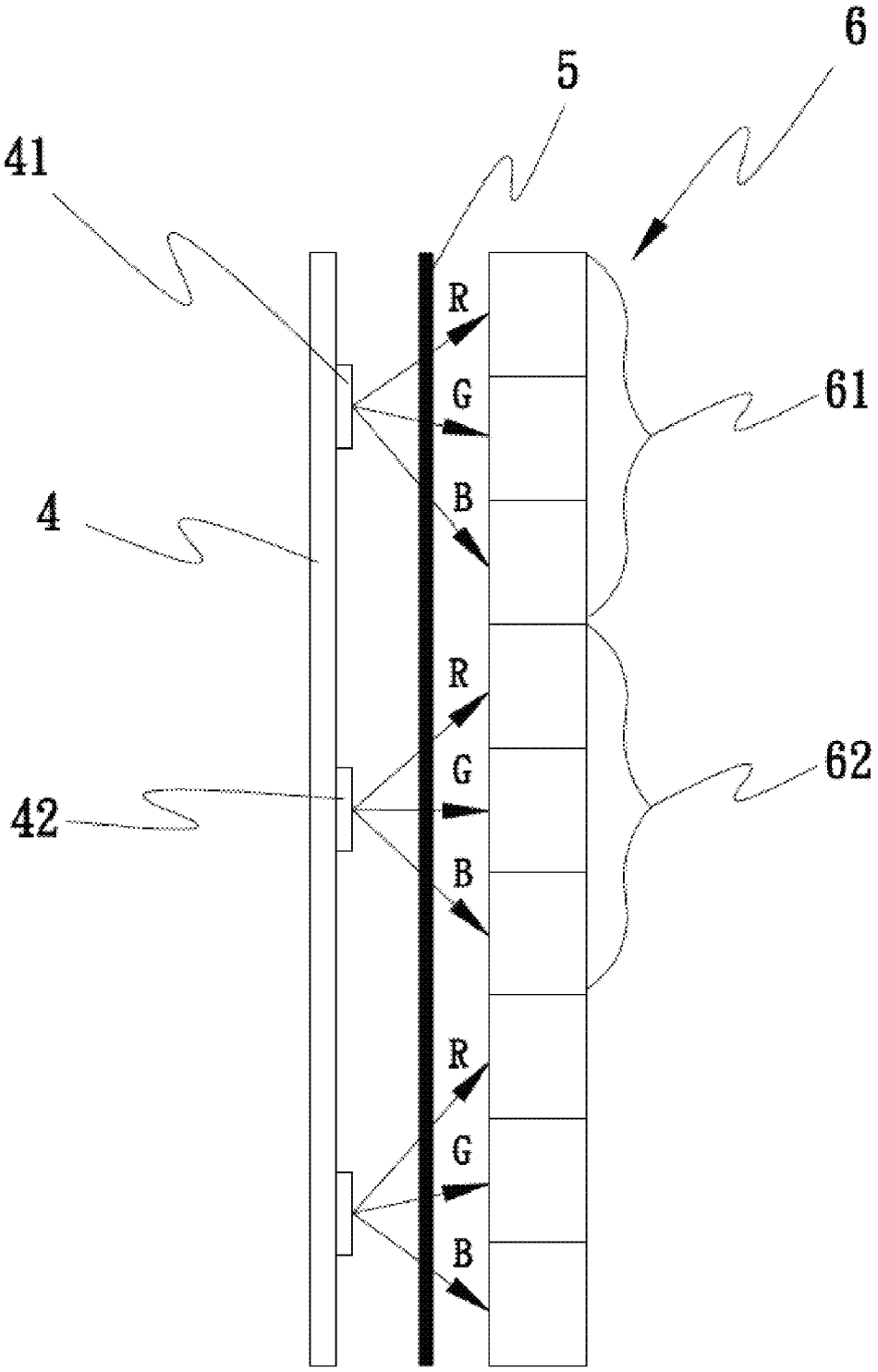
FIG. 5 is a schematic side view of the embodiment shown in FIG. 4.

FIG. 3 shows the steps for selecting an appropriate "virtually primary color". In Step 31, the three sub-cells in each cell are initially measured one after another for tri-stimulus values under the condition that the corresponding light valves are set in a fully open state. The light passing through the red sub-cell of the i-th cell is defined herein to have a tri-stimulus value of $(X_r, Y_r, Z_r)_i$, whereas the light passing through the green sub-cell thereof has a value of $(X_g, Y_g, Z_g)_i$ and the light passing through the blue sub-cell has a value of $(X_b, Y_b, Z_b)_i$. These values correspond to chromaticity coordinates of $(x_r, y_r)_i$, $(x_g, y_g)_i$ and $(x_b, y_b)_i$, respectively. In the embodiment shown in FIGS. 4 and 5, a plurality of direct-type LEDs 41, 42 . . . are mounted on a substrate 4 to serve as a backlight source for an LCD. The light from the backlight source passes through a color filter 5 and then reaches the cells disposed in a liquid crystal module 6. Due to the slimness of the backlight in an LCD TV according to this embodiment, each of the cells 61, 62 can only receive light from a single LED 41 or 42. Given the fact that each of cells are disposed at a different angle with respect to its light source, the uniformity of light received by the cells is inversely proportional to the thickness of the backlight. This may cause a huge difference in the chromaticity and brightness among the respective cells.

Figure 6:
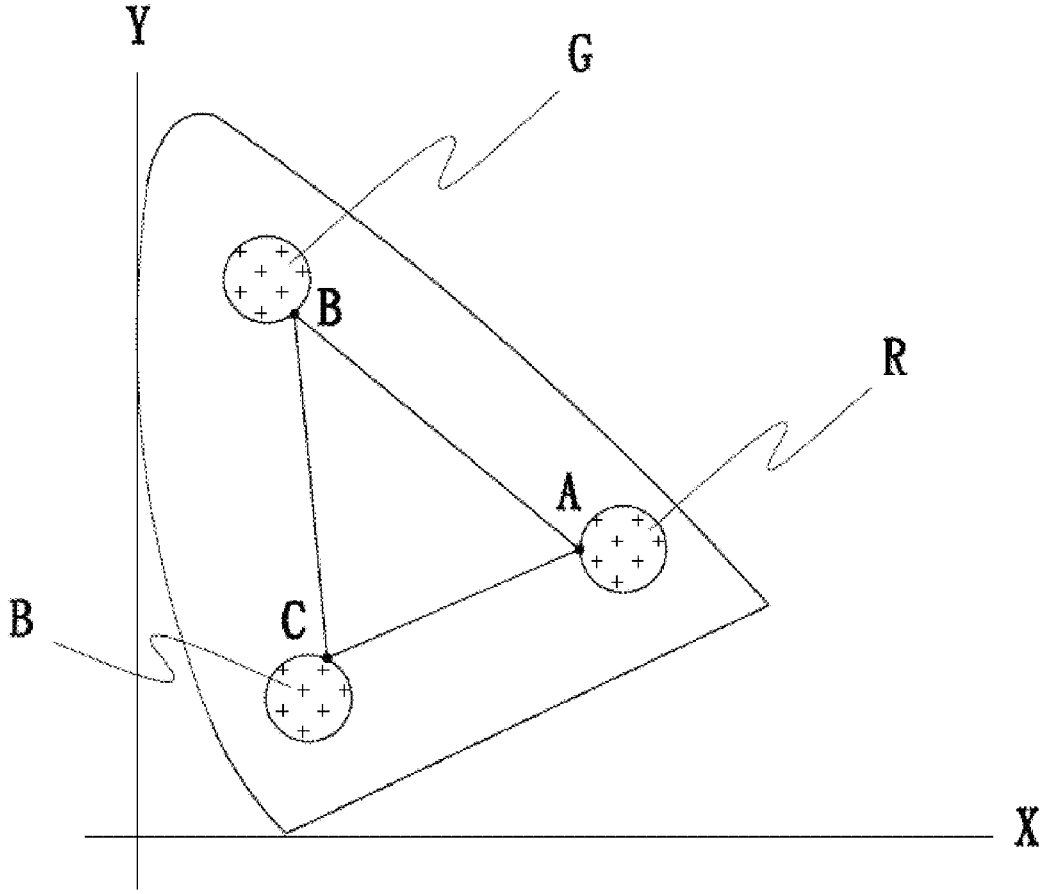
FIG. 6 is a schematic chromaticity diagram showing the chromaticity coordinates of light beams passing through respective sub-cells according to the embodiment shown in FIG. 4, which explains the rule for selecting the virtually primary color.

In Step 32, the chromaticity coordinates of the sub-cells in the respective cell locations are plotted in the CIE 1931 Chromaticity Diagram. Referring to FIG. 6, the R region plotted therein designates the chromaticity coordinates of the lights passing through the red sub-cells, while the G region designates the chromaticity coordinates of the lights passing through all of the green sub-cells and the B region designates a set of the chromaticity coordinates of the lights passing through all of the blue sub-cells. Definitely, it will be readily apparent to those skilled in the art that Step 32 is proposed for a better understanding of the invention, it is not necessary to essentially plot any chromaticity coordinates in the diagram during an actual operation.

Next, in Step 33, a value equal to or smaller than the minimum $X_r$ value of all the tri-stimulus values $(X_r, Y_r, Z_r)_i$ of the red sub-cells is selected to serve as a stimulus value X for the red color component of the virtually primary color, i.e., $X_{rv} \leq (X_r)_{min}$. Meanwhile, a value equal to or larger than the maximum $Y_r$ value is selected to act as a stimulus value Y for the red color component of the virtually primary color, i.e., $Y_{rv} \geq (Y_r)_{max}$, and a value equal to or larger than the maximum $Z_r$ is selected to act as a stimulus value Z, i.e., $Z_{rv} \geq (Z_r)_{max}$.

Accordingly, the standard chromaticity coordinates of the red color component of the virtually primary color are given to be $$x_{rv} = \frac{X_{rv}}{X_{rv} + Y_{rv} + Z_{rv}},$$

$$y_{rv} = \frac{Y_{rv}}{X_{rv} + Y_{rv} + Z_{rv}},$$

which correspond to the point A denoted in FIG. 6. Among all of chromaticity values presented by the red sub-cells, the point A represents the most distant point from pure red color and, therefore, all of the red sub-cells are able to achieve the standard chromaticity.

By the same token, a value equal to or smaller than the minimum $Y_g$ value of all the tri-stimulus values $(X_{gi}, Y_{gi}, Z_{gi})$ of the green sub-cells is selected to serve as a stimulus value Y for the green color component of the virtually primary color, i.e., $Y_{gv} \leq (Y_g)_{min}$. Meanwhile, a value equal to or larger than the maximum $X_g$ value and a value equal to or larger than the maximum $Z_g$ value are selected to act as the stimulus values X and Z for the green color component of the virtually primary color, respectively, i.e., $X_{gv} \geq (X_g)_{max}$ and $Z_{gv} \geq (Z_g)_{max}$. The standard chromaticity coordinates of the green color component of the virtually primary color are therefore obtained to be $$x_{gv} = \frac{X_{gv}}{X_{gv} + Y_{gv} + Z_{gv}},$$

$$y_{gv} = \frac{Y_{gv}}{X_{gv} + Y_{gv} + Z_{gv}},$$

which correspond to the point B denoted in FIG. 6. The standard chromaticity coordinates of the blue color component of the virtually primary color are obtained in like manner with $Z_{bv} \leq (Z_b)_{min}$, $X_{bv} \geq (X_b)_{max}$ and $Y_{bv} \geq (Y_b)_{max}$, and represented by the coordinates of $$x_{bv} = \frac{X_{bv}}{X_{bv} + Y_{bv} + Z_{bv}},$$

$$y_{bv} = \frac{Y_{bv}}{X_{bv} + Y_{bv} + Z_{bv}},$$

corresponding to the point C shown in FIG. 6.

It should be noted that the virtually primary color is not limited to having the values mentioned above but includes other values selected according to the process described above. Nevertheless, the bigger the area of the triangle defined by the chromaticity coordinates of the three components of the virtually primary color is, the more vivid color can be presented. The virtually primary color corresponds to the chromaticity capable of being presented by all of the cells in a display that includes a given liquid crystal module accompanied with a given backlight provided at rear side. That is to say, the respective cells in a given display may show equal chromaticity upon receipt of the same original image signal $(S_r, S_g, S_b)$ that is responsible for adjusting the light transmission ratios of the respective cells and, accordingly, the color appearance is rendered uniform over the entire picture shown in the display.

When the tri-stimulus values of the three sub-cells of a given cell i (as measured when the light valves are set in a fully open state) are adjusted to correspond to the virtually primary color described above and have values of $(X_{rv}, Y_{rv}, Z_{rv})$, $(X_{gv}, Y_{gv}, Z_{gv})$ and $(X_{bv}, Y_{bv}, Z_{bv})$, respectively, the actual tri-stimulus values $(X_i, Y_i, Z_i)$ presented by the pixel at the cell location i by inputting an original image signal $(S_r, S_g, S_b)_i$ are equal to:

$$\begin{bmatrix} X_i \\ Y_i \\ Z_i \end{bmatrix} = \begin{bmatrix} X_{rv} & X_{gv} & X_{bv} \\ Y_{rv} & Y_{gv} & Y_{bv} \\ Z_{rv} & Z_{gv} & Z_{bv} \end{bmatrix} \begin{bmatrix} S_r \\ S_g \\ S_b \end{bmatrix}_i. \tag{3}$$

Given that the cell i, when measured when the light valves are set in a fully open state, demonstrates tri-stimulus values of $(X_r, Y_r, Z_r)_i$, $(X_g, Y_g, Z_b)_i$, $(X_b, Y_b, Z_b)_i$, the cell i, in response to receipt of a compensated image signal $(S_r', S_g', S_b')_i$, shows tri-stimulus values of $(X_i', Y_i, Z_i')$ represented by the following equation:

$$\begin{bmatrix} X_i' \\ Y_i' \\ Z_i' \end{bmatrix} = \begin{bmatrix} X_r & X_g & X_b \\ Y_r & Y_g & Y_b \\ Z_r & Z_g & Z_b \end{bmatrix}_i \begin{bmatrix} S_r' \\ S_g' \\ S_b' \end{bmatrix}_i. \tag{4}$$

In other words, compensation information is used in this case for converting the original image signal $(S_r, S_g, S_b)_i$ to the compensated image signal $(S_r', S_g', S_b')_i$ and for bringing the tri-stimulus values $(X_i', Y_i, Z_i')$ which is to be presented by a pixel at the cell location i in response to the compensated image signal $(S_r', S_g', S_b')_i$ to be equal to the tri-stimulus values $(X_i, Y_i, Z_i)$ that are expectedly presented by inputting the original image signal $(S_r, S_g, S_b)_i$ to an LCD display where the virtually primary color serves to constitute three primary colors.

In Step 34, the tri-stimulus values of light passing through the three sub-cells in every cell of the display as measured when the light valves are set in a fully open state are compared with those of the virtually primary color and calculated in a weighted manner to determine the weight that each color component should be given to match with its corresponding component in the virtually primary color. That is to say, as a result of transmitting the compensated image signal to the cells, the tri-stimulus values $(X_i', Y_i', Z_i')$ of a resultant color image are rendered equal to the tri-stimulus values $(X_i, Y_i, Z_i)$ presented when the virtually primary color serves as three primary colors during input of the original image signal. This relationship gives an equation, where:

$$\begin{bmatrix} X_r & X_g & X_b \\ Y_r & Y_g & Y_b \\ Z_r & Z_g & Z_b \end{bmatrix}_i \begin{bmatrix} S_r' \\ S_g' \\ S_b' \end{bmatrix}_i = \begin{bmatrix} X_{rv} & X_{gv} & X_{bv} \\ Y_{rv} & Y_{gv} & Y_{bv} \\ Z_{rv} & Z_{gv} & Z_{bv} \end{bmatrix} \begin{bmatrix} S_r \\ S_g \\ S_b \end{bmatrix}_i. \tag{5}$$

This equation may be simplified to give:

$$M_i[S']_i = M_v[S]_i \tag{6}.$$

And this may be further transformed into:

$$[S']_i = M_i^{-1} * M_v [S]_i = (MT)_i [S]_i \quad (7).$$

If an image signal locates within the region defined by the virtually primary color in the Chromaticity Diagram, the compensated image signal ($S_r'$, $S_g'$, $S_b'$) converted by Equation (7) should have a solution of larger than 0. Meanwhile, any original image signal $(S_r, S_g, S_b)_i$ transmitted to the i-th cell will be compensated for according to Equation (7), such that the chromaticity and brightness of the pixel presented at the i-th cell are as good as those presented in response to receipt of the original image signal under an ideal condition where the virtually primary color acts as three primary colors. Since the entire picture is unified based upon a single virtually primary color, uniform chromaticity and brightness can be achieved over the entire picture. Such being the case, if all of the LCD products in a production line are set based upon the same virtually primary color, these LCD products would present the same chromaticity and brightness.

According to Equation (7), the calculating procedure in Step 34 above can be realized by determining the matrix value of $M_i^{-1} * M_v$ for each and every cell i in an LCD panel. Each cell i is initially computed for tri-stimulus value matrix for three primaries under the condition where light valves are in a fully open state, thereby obtaining an inverse matrix $M_i^{-1}$ of the tri-stimulus value matrix. The inverse matrix is then applied to a suitable tri-stimulus value matrix $M_v$ for the virtually primary color selected in Step 33 to obtain the value of $M_i^{-1} * M_v$ and generate a 3×3 transformed matrix $(M_T)_i$. The transformed matrix $(M_T)_i$ is then stored in a memory device, such as a non-volatile memory device (E2PROM).

For a high-definition television (HDTV) in the form of an LCD TV, it provides a resolution of two mega pixels and, therefore, has two million cells in structure. Given that 9 bytes of memory space is required per cell for storage of the matrix data, the E2PROM should have a total memory space of approximate 18 M bytes. As shown in Step 35, a display receives image data of multiple original image signals from an image source, with each original image signal governing the light transmission ratio of the corresponding cell.

Next, in Step 36, a hardware-based application-specific integrated circuit (ASIC) is employed to perform a real-time, logic parallel operation on the image signals of the image data in accordance with the corresponding adjustment regions. As illustrated in Equation (7-1), the transformed matrix $(M_T)_i$ are applied in a weighted manner to each of the original image signals, thereby giving compensated image data that include respective compensated image signals for the respective corresponding cells. Finally, in Step 37, the liquid crystal module determines the light transmission ratio for a given cell based on the resultant compensated image signal ($S_r'$, $S_g'$, $S_b'$). By this way, any original image signal ($S_r$, $S_g$, $S_b$) can be subjected to real-time image processing to generate a compensated image signal corresponding thereto.

A compensated image signal is intentionally determined by referring to the presented chromaticity of a cell under illumination of a corresponding backlight source. The "virtually primary color" serves as a unified standard that allows all of the cells to present identical chromaticity and brightness. Therefore, the hardware problem of non-uniform chromaticity that inheres in an LED display is successfully addressed by reciprocal compensation among sub-cells through application of the compensation data. As a special example of the invention, if an original image signal directed to pure red color, where $(S_r, S_g, S_b)_i = (1,0,0)$, is for instance subjected to the compensation according to the invention, it would be adjusted to become a compensated image data where $S_{ri}'$ is smaller than 1 and at least one of $S_{gi}'$ and $S_{bi}'$ is larger than 0, such that the difference between the red color component of the virtually primary color and the color presented by the red sub-cell at the cell location i when the light valve is set in a fully open state is compensated for.

According to the concurrent technology where a white backlight source is generated by exciting a phosphor powder using a blue light LED chip, a major drawback of the white-light LED is known to be that the emission spectrum thereof shows a low level of red component and makes the illuminated subjects pale bluish in appearance. A solution thereto is to reduce the transmittance of green and blue components so as to render the emitted light more reddish in chromaticity. Such a solution, however, also results in a reduced overall brightness and there arises a further problem of insufficient brightness. In the context of solving the further problem of insufficient brightness and enhancing the overall brightness of the backlight, there exist technical difficulties in supplying extra electrical current to the backlight and building additional structures for heat dissipation. These would also bring about a disadvantageous increase in the manufacture cost.

Figure 1:
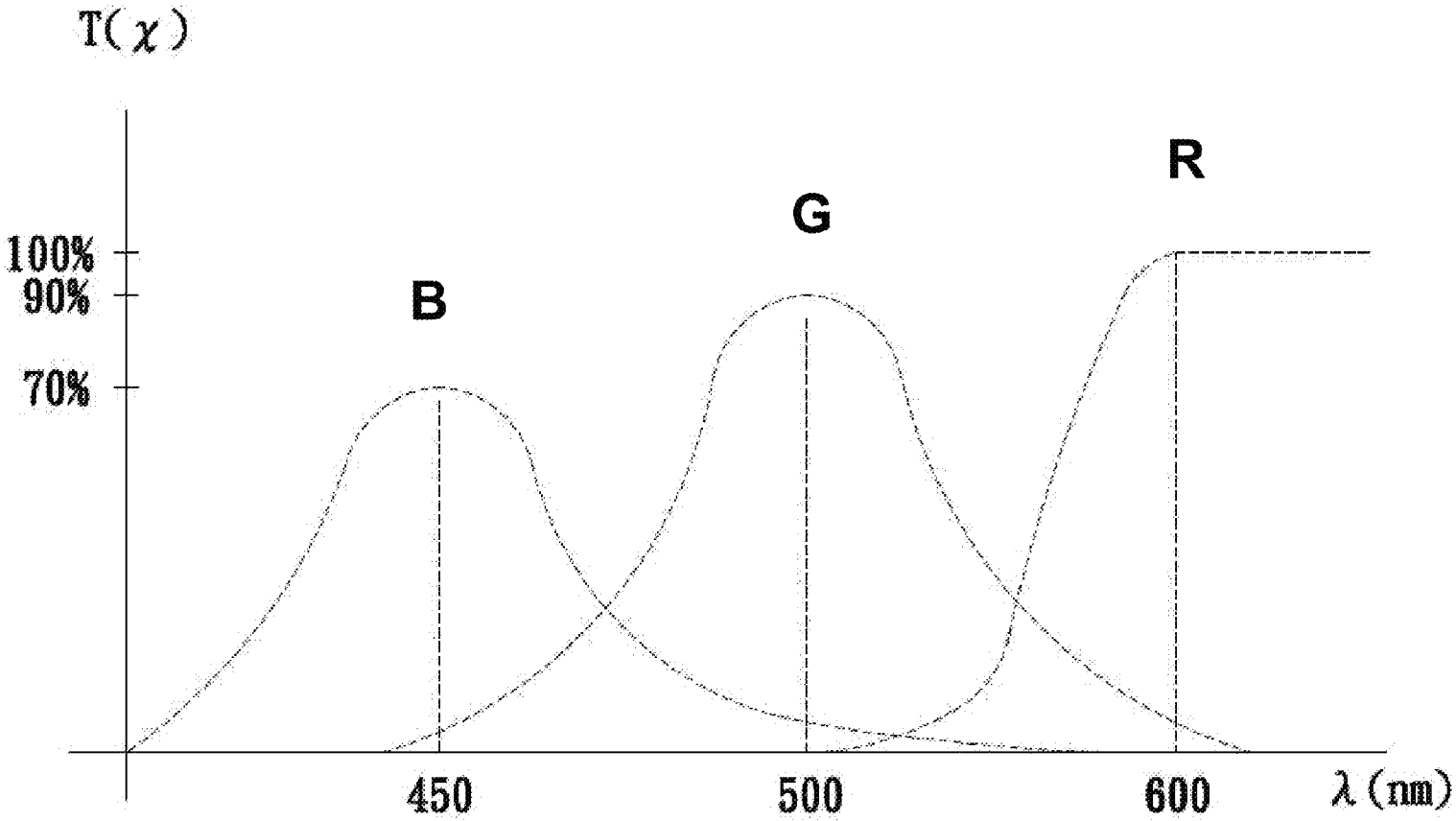
PRIOR ART FIG.1
FIG. 1 is a schematic diagram illustrating the variation in light transmittance of a conventional color filter against wavelength.
Figure 2:
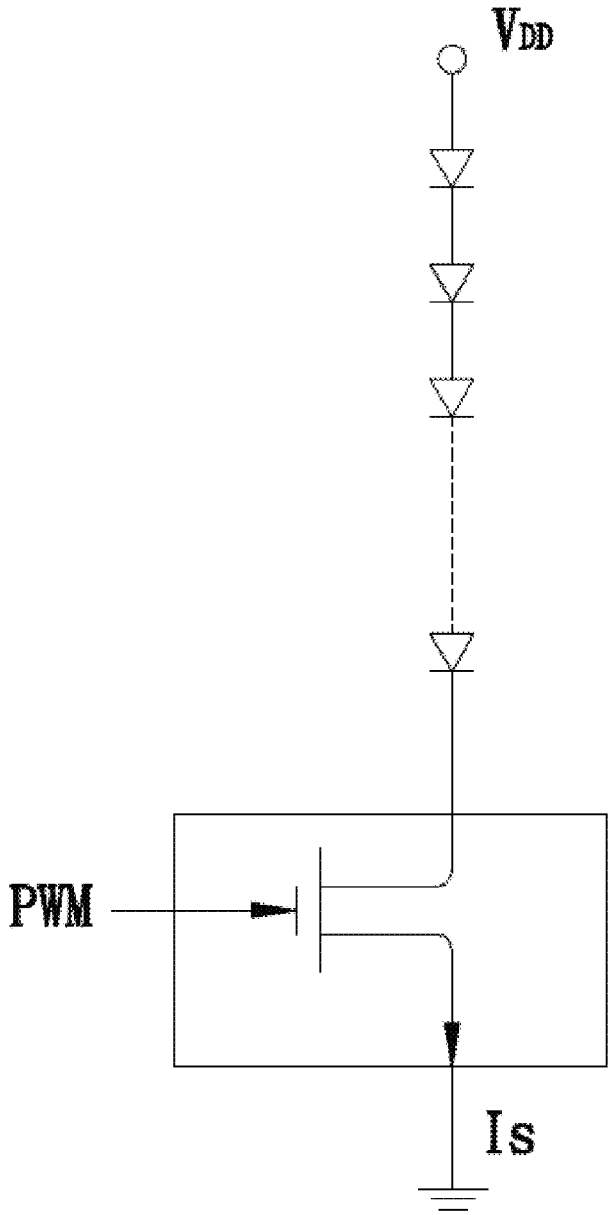
PRIOR ART FIG.2
FIG. 2 is a circuit diagram illustrating a conventional circuit for driving a light-emitting diode.
Figure 7:
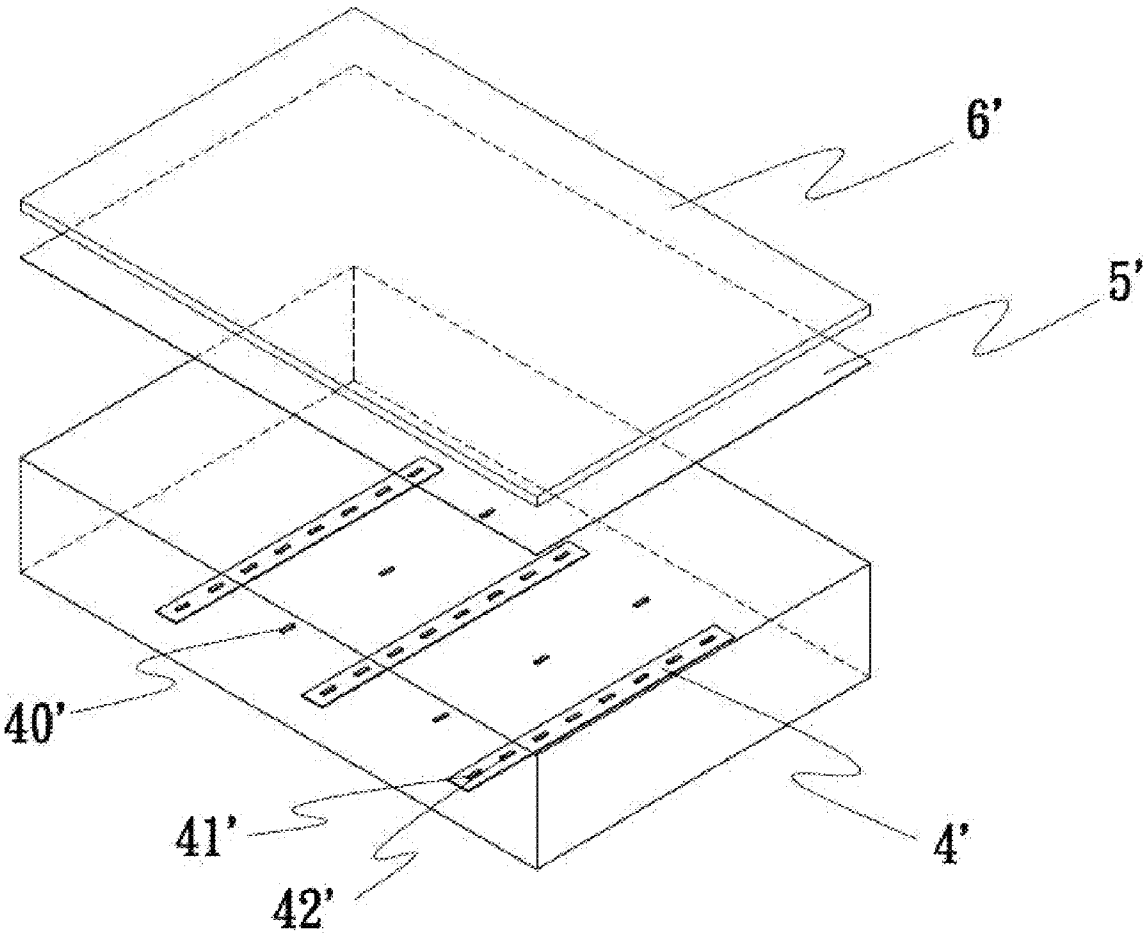
FIG. 7 is an exploded schematic diagram illustrating a liquid crystal display according to the second preferred embodiment of the invention.

According to the second embodiment of the invention, a 42-inch LCD-TV is shown in FIG. 7, wherein a total 2,000 of white-light LEDs 41', 42' with luminous efficacy of 5 lm/W are mounted in a backlight. Assuming that the white-light LEDs 41', 42' have chromaticity coordinates of (0.28, 0.3) and thus emit bluish white light, then the red light component can be elevated by adding 200 pieces of red-light LEDs 40' with efficacy of 2 lm/W. Since the emission spectrum of the red-light LEDs 40' falls right within the R zone of the transmittance spectrum T(λ) of a color filter shown in FIG. 1 and therefore exhibits highest transmittance, the addition of the red-light LEDs 40' results in an increased overall chromaticity coordinate Δx of the backlight of around 0.38, whereby the skin color component in a displayed image is elevated.

However, it is quite impossible to uniformly distribute the light emanating from the 200 pieces of red-light LEDs 40' over a huge area of a 42-inch display panel. In the light of the inventive technology described above, the non-uniform distribution of the light from the red-light LEDs 40' can be compensated for by inputting an image signal modified according to the invention. The bluish appearance of an image can be further compensated for by selecting a virtually primary color with more reddish component, so as to shift the chromaticity values of the image to a more reddish zone in the Chromaticity Diagram. By way of the inventive method, a display is no longer required to either reduce the transmittance of green and blue lights through a color filter 5' or reduce the light transmission ratios of green and blue sub-cells in a crystal module 6'. The overall brightness of the display need not be compromised for chromaticity accordingly.

Figure 8:
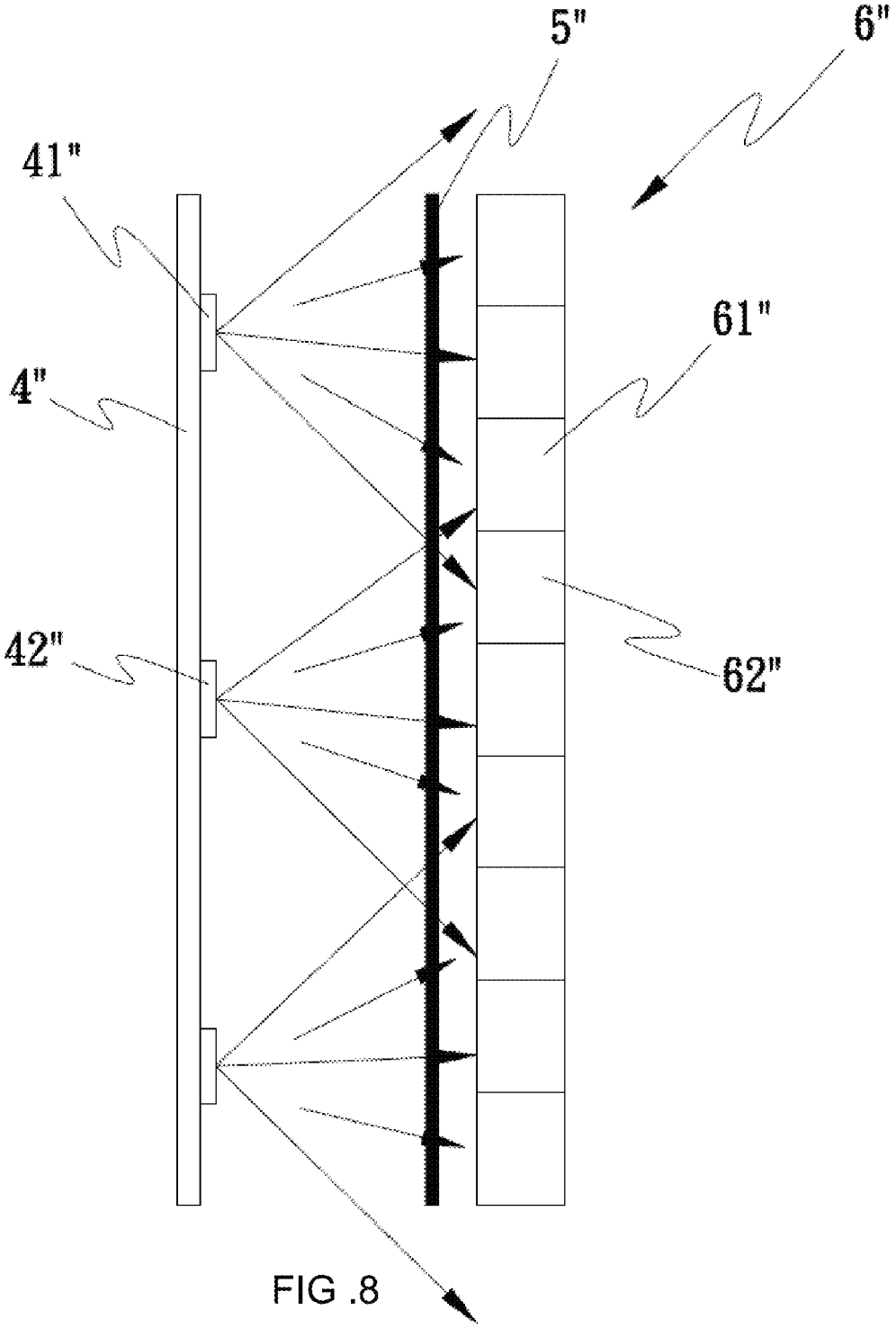
FIG. 8 is a schematic side view illustrating the structure of the third preferred embodiment of the invention.
Figure 9:
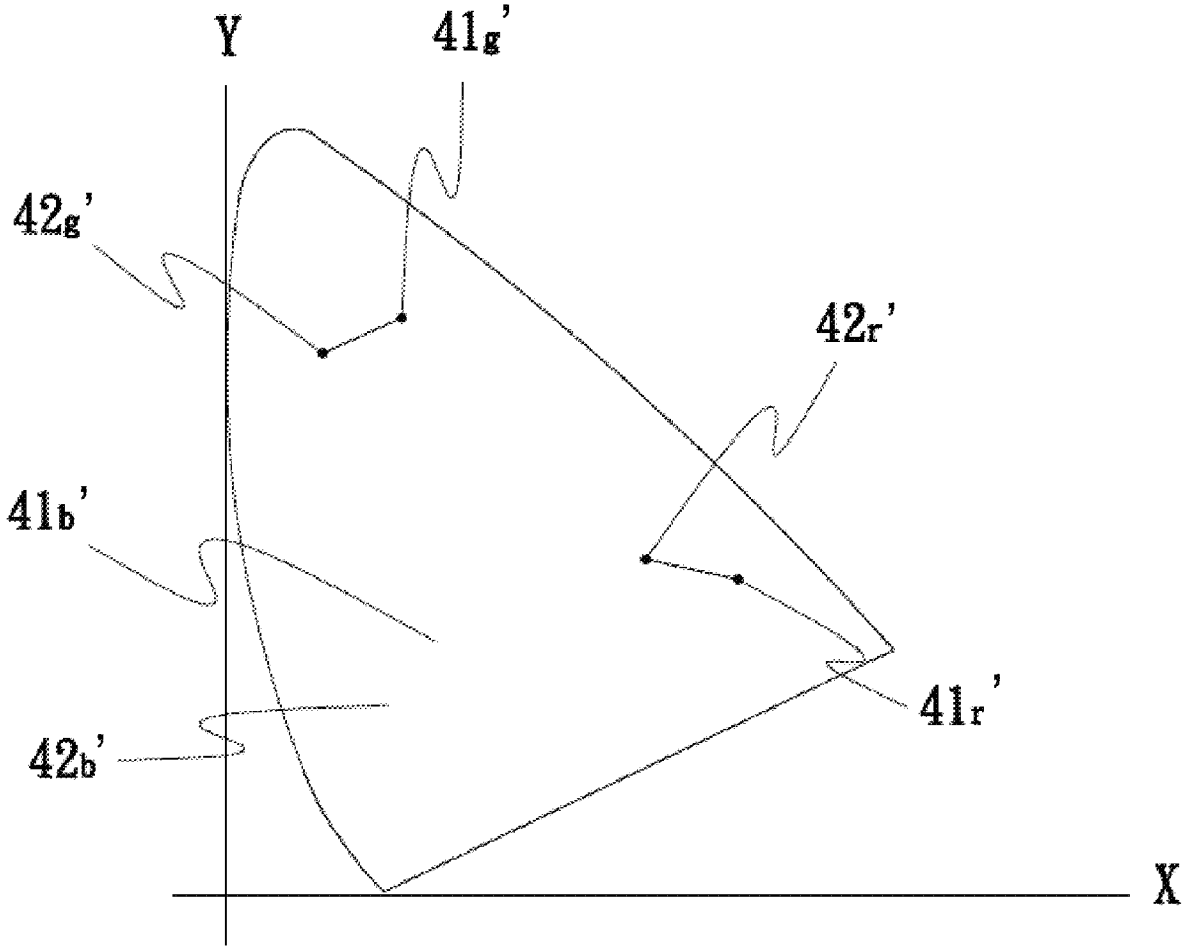
FIG. 9 is a schematic chromaticity diagram showing the chromaticity coordinates of light beams passing through a cell in the embodiment shown in FIG. 8, indicating that two different light sources affect a single cell in a weighted manner.

The third embodiment of the invention is shown in FIG. 8, where a backlight 4" is distally disposed with respect to a color filter 5" and a liquid crystal module 6". As such, light beams emitted from respect LEDs may overlap with one another such that respective cells 61", 62" may receive illumination from more than one of LEDs 41", 42" at the same time. For illustrative purpose, R, G and B sub-cells of a cell 61" are defined to receive light from the LED 41" with an illumination coefficient $\lambda_1$ and from the LED 42" with an illumination coefficient $\lambda_2$. That is to say, when illuminated by the LED 41" alone (i.e., $\lambda_1=1, \lambda_2=0$), the R, G, B sub-cells have chromaticity coordinates denoted $(x_{k1}, y_{k1})$ (k=r, g, b) in the Chromaticity Diagram, which correspond to points $41_r'$, $41_g'$ and $41_b'$ shown in FIG. 9, respectively. When illuminated by the LED 42" alone (i.e., $\lambda_1=0, \lambda_2=1$), the R, G, B sub-cells have chromaticity coordinates denoted ($x_{k2}$, $y_{k2}$) (k=r, g, b) in the Chromaticity Diagram, which correspond to points 42$_r$', 42$_g$' and 42$_b$' shown in FIG. 9, respectively. According to the principle of color mixing, when illuminated by the LED 41" with an illumination coefficient $\lambda_1$ ($0 \le \lambda_1 \le 1$) and at the same time by LED 42" with an illumination coefficient $\lambda_2$ ($0 \le \lambda_2 \le 1$), the R, G, B sub-cells will have chromaticity coordinates denoted ($x_{km}$, $y_{km}$), in which:

$$x_{km} = \frac{\lambda_1}{\lambda_1 + \lambda_2} x_{k1} + \frac{\lambda_2}{\lambda_1 + \lambda_2} x_{k2} \quad (8)$$

$$y_{km} = \frac{\lambda_1}{\lambda_1 + \lambda_2} y_{k1} + \frac{\lambda_2}{\lambda_1 + \lambda_2} y_{k2}$$

$$k = (r, g, b).$$

It can tell from Equation (8) that the chromaticity coordinates resulting from color mixing will definitely locate at a point in a line defined by two points 41$_r$' and 42$_r$', in a line defined by points 41$_g$' and 42$_g$', and in a line defined by points 41$_b$' and 42$_b$', respectively. The distances of the resultant chromaticity coordinates to the respective points are determined in a weighted manner based on the spatial relationship of the LEDs 41", 42" to a cell 61".

Based upon the description above, when illuminated by the LED 41" alone (i.e., $\lambda_1$=1, $\lambda_2$=0), the R, G, B sub-cells of a cell i, in response to receipt of a compensated image signal ($S_r$', $S_g$', $S_b$'), emit a light having tri-stimulus values ($X_1$', $Y_1$', $Z_1$') capable of being represented numerically by the following equation:

$$\begin{bmatrix} X_1' \\ Y_1' \\ Z_1' \end{bmatrix} = \begin{bmatrix} X_{r1} & X_{g1} & X_{b1} \\ Y_{r1} & Y_{g1} & Y_{b1} \\ Z_{r1} & Z_{g1} & Z_{b1} \end{bmatrix} \begin{bmatrix} S_r' \\ S_g' \\ S_b' \end{bmatrix} \equiv M_1 \begin{bmatrix} S_r' \\ S_g' \\ S_b' \end{bmatrix}. \quad (7\text{-}1)$$

On the other hand, when illuminated by the LED 42" alone (i.e., $\lambda_1$=0, $\lambda_2$=1), the R, G, B sub-cells, in response to receipt of a compensated image signal ($S_r$', $S_g$', $S_b$'), emit a light having tri-stimulus values ($X_2$', $Y_2$', $Z_2$') represented by the following equation:

$$\begin{bmatrix} X_2' \\ Y_2' \\ Z_2' \end{bmatrix} = \begin{bmatrix} X_{r2} & X_{g2} & X_{b2} \\ Y_{r2} & Y_{g2} & Y_{b2} \\ Z_{r2} & Z_{g2} & Z_{b2} \end{bmatrix} \begin{bmatrix} S_r' \\ S_g' \\ S_b' \end{bmatrix} \equiv M_2 \begin{bmatrix} S_r' \\ S_g' \\ S_b' \end{bmatrix}. \quad (7\text{-}2)$$

Therefore, when illuminated by the LED 41" with an illumination coefficient $\lambda_1$ and at the same time by LED 42" with an illumination coefficient $\lambda_2$, the R, G, B sub-cells, in response to receipt of a compensated image signal ($S_r$', $S_g$', $S_b$'), will emit a mixed light having tri-stimulus values ($X_T$', $Y_T$', $Z_T$') represented by the following equation:

$$\begin{bmatrix} X_T' \\ Y_T' \\ Z_T' \end{bmatrix} = \lambda_1 \begin{bmatrix} X_1' \\ Y_1' \\ Z_1' \end{bmatrix} + \lambda_2 \begin{bmatrix} X_2' \\ Y_2' \\ Z_2' \end{bmatrix} = (\lambda_1 M_1 + \lambda_2 M_2) \begin{pmatrix} S_r' \\ S_g' \\ S_b' \end{pmatrix}. \quad (7\text{-}3)$$

When requiring that the tri-stimulus values of the mixed light be equal to the tri-stimulus values presented when the selected virtually primary color serves as three primary colors during input of the original image signal $S_r$, $S_g$, $S_b$, there exists a relationship:

$$(\lambda_1 M_1 + \lambda_2 M_2) \begin{pmatrix} S_r' \\ S_g' \\ S_b' \end{pmatrix} = M_v \begin{pmatrix} S_r \\ S_g \\ S_b \end{pmatrix} \quad (9)$$

$$(\lambda_1 M_v^{-1} M_1 + \lambda_2 M_v^{-1} M_2) \begin{pmatrix} S_r' \\ S_g' \\ S_b' \end{pmatrix} = \begin{pmatrix} S_r \\ S_g \\ S_b \end{pmatrix}$$

And it gives:

$$\begin{pmatrix} S_r' \\ S_g' \\ S_b' \end{pmatrix} = (\lambda_1 M_v^{-1} M_1 + \lambda_2 M_v^{-1} M_2)^{-1} \begin{pmatrix} S_r \\ S_g \\ S_b \end{pmatrix}. \quad (10)$$

It can tell from Equation (10) that the compensated image signal ($S_r$', $S_g$', $S_b$') is obtainable through matrix calculation $M_v^{-1}M_1$ and $M_v^{-1}M_2$, followed by introducing the illumination coefficients $\lambda_1$ and $\lambda_2$ in a weighted manner by linear calculation and further computing through inverse matrix calculation. The calculation of $M_v^{-1}M_1$ and $M_v^{-1}M_2$ can be done in an off-line computer, so that a 3×3 matrix is obtained and subsequently stored in a memory device. Assuming that 1000 pieces of LEDs with various brightness and chromaticity levels are used to constitute a backlight, a total 1000 of $M_i$ matrixes and an $M_v$ matrix representing the selected virtually primary color are subjected to calculation for determining $M_v^{-1}M_1$ and $M_v^{-1}M_2$. The resultant values are then stored in E2PROM (which should have a total memory space of 1001×9 words). For each cell i, the most critical $\lambda_k$ values to the corresponding pixel (namely, illumination coefficients with higher values) should be stored. For instance, assuming that every cell in a panel is adjacent at its up, down, left and right sides to four critical LEDs, and that the panel has a total two mega number of cells, 2M×16=32M words of memory space is required for storage of the relevant data. Accordingly, the converting signal ($S_r$', $S_g$', $S_b$')$_i$ for a given cell i can be extended by the following equation:

$$\begin{pmatrix} S_r' \\ S_g' \\ S_b' \end{pmatrix}_i = \left( \sum_{k=j}^{j+m} \lambda_{ik} M_v^{-1} M_k \right)^{-1} \begin{pmatrix} S_r \\ S_g \\ S_b \end{pmatrix}_i, \quad (11)$$

wherein $LED_j$, $LED_{j+1}$, . . . $LED_{j+m}$ represent m+1 critical LEDs to the cell i.

Figure 10:
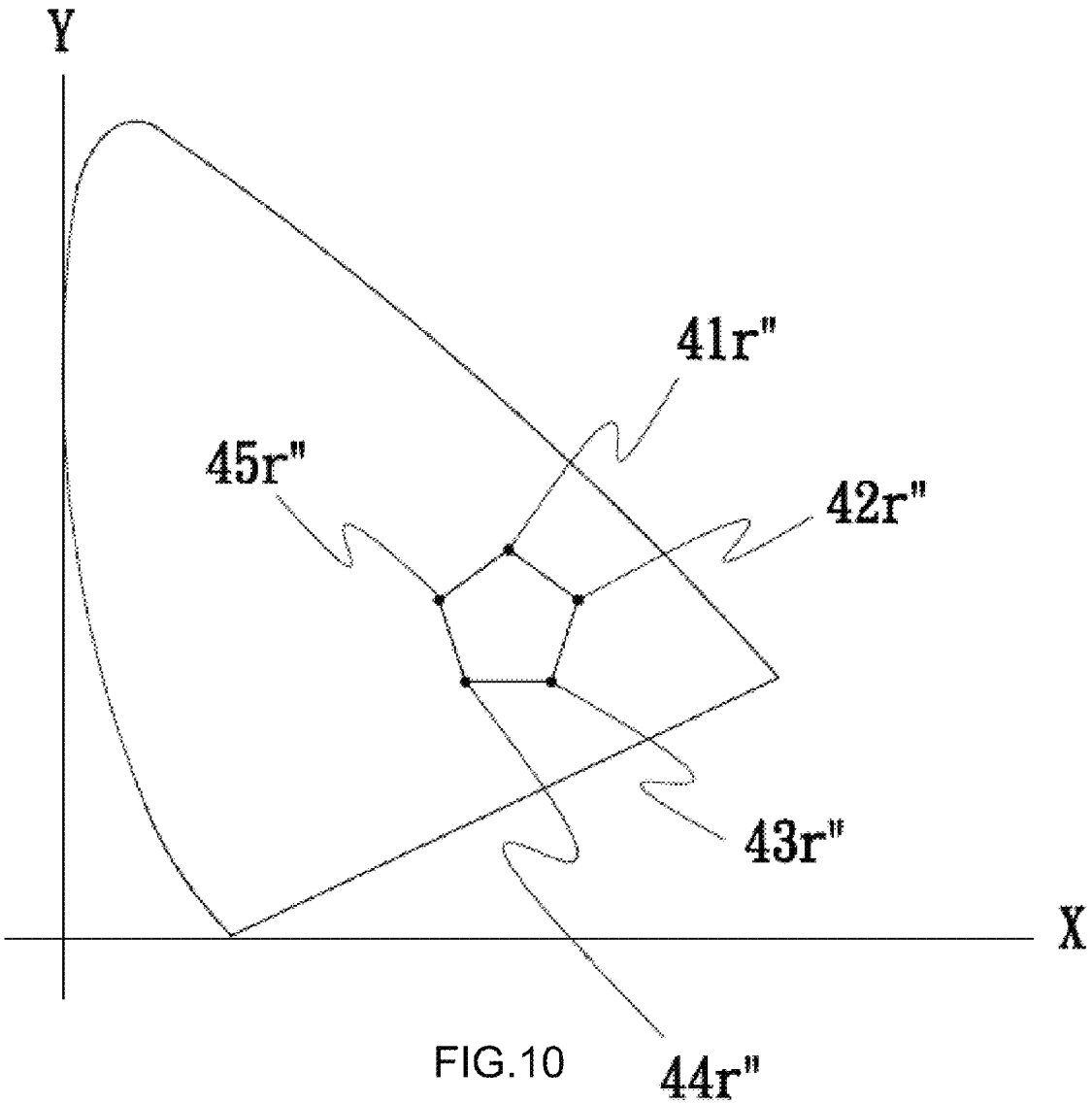
FIG. 10 is a schematic chromaticity diagram showing the chromaticity coordinates of light beams passing through a cell in the embodiment shown in FIG. 8, wherein the cell is affected by multiple light sources.

Therefore, if a given cell i is critically affected by five LEDs, the cell i would present a red-light component upon receiving the mixed light emitted from the five LEDs. As shown in FIG. 10, the red light presented at the cell i as a result of color mixing will definitely have chromaticity coordinates located at a point inside the pentagon defined by coordinates 41*r*", 42*r*", 43*r*", 44*r*" and 45*r*" which are generated respectively by subjecting the cell i to illumination from each of the LEDs alone. In other words, any given cell in a panel will definitely have basic chromaticity coordinates located inside of a basic chromaticity zone defined by subjecting the cell to illumination from individual LEDs, such as the R, G and B regions shown in FIG. 6, irrespective of the number of LEDs mounted on the backlight or whether the light beams emitted from respect LEDs overlap with one another. This also means that even if an individual cell may be affected by the mixed light illumination from multiple LEDs mounted on the backlight, suitable virtually primary color can still be selected according to the invention.

Furthermore, if a backlight is provided with a function of local dimming control, by which the brightness level of an individual region $LED_k$ can be controlled to have a value of $\alpha_k$ ($0 \le \alpha_k \le 1$), the tri-stimulus value matrix $M_i$ for LEDs in the region could be rewritten as $\alpha_k M_k$. After determination of respective $LED_k$ brightness control, the original image signal transmitted to a given cell i should be converted to a compensated image signal, so as to maintain an ideal displayed image. Accordingly, the Equation (11) should be rewritten to read:

$$\begin{pmatrix} S'_r \\ S'_g \\ S'_b \end{pmatrix}_i = \left( \sum_{k=j}^{j+m} \lambda_{ik} \alpha_k M_v^{-1} M_k \right)^{-1} \begin{pmatrix} S_r \\ S_g \\ S_b \end{pmatrix}. \tag{12}$$

By use of Equation (12), a compensated image signal ($S_r'$, $S_g'$, $S_b'$) for local dimming control may be obtained with uniform chromaticity and brightness, indicating that the invention can solve the problem of cross-talk among local dimming control regions and the non-uniformity in chromaticity and brightness. It is shown that the invention successfully drives an LCD device by selecting a less saturated virtually primary color as a common target color, followed by modifying image signals. When an original image signal ($S_r$, $S_g$, $S_b$) represents a single color component (i.e., only one of $S_r$, $S_g$, $S_b$ has a value of larger than 0 with the rest two being 0), it is converted into a new image signal ($S_r'$, $S_g'$, $S_b'$) using Equation (7-1), in which $S_r'$, $S_g'$ and $S_b'$ may all have values of lager than 0. In other words, if an original image signal represents only red color as the basic color, it would be compensated for to become a less saturated red color component of the virtually primary color. As such, green and blue sub-pixels may also be slightly presented for constituting the less saturated red color. Given the fact that LEDs normally provide a high color gamut, the so-called "less saturated virtually primary color," in actuality, still provides a broad color range sufficient to constitute a color LCD panel with high picture quality.

Figure 11:
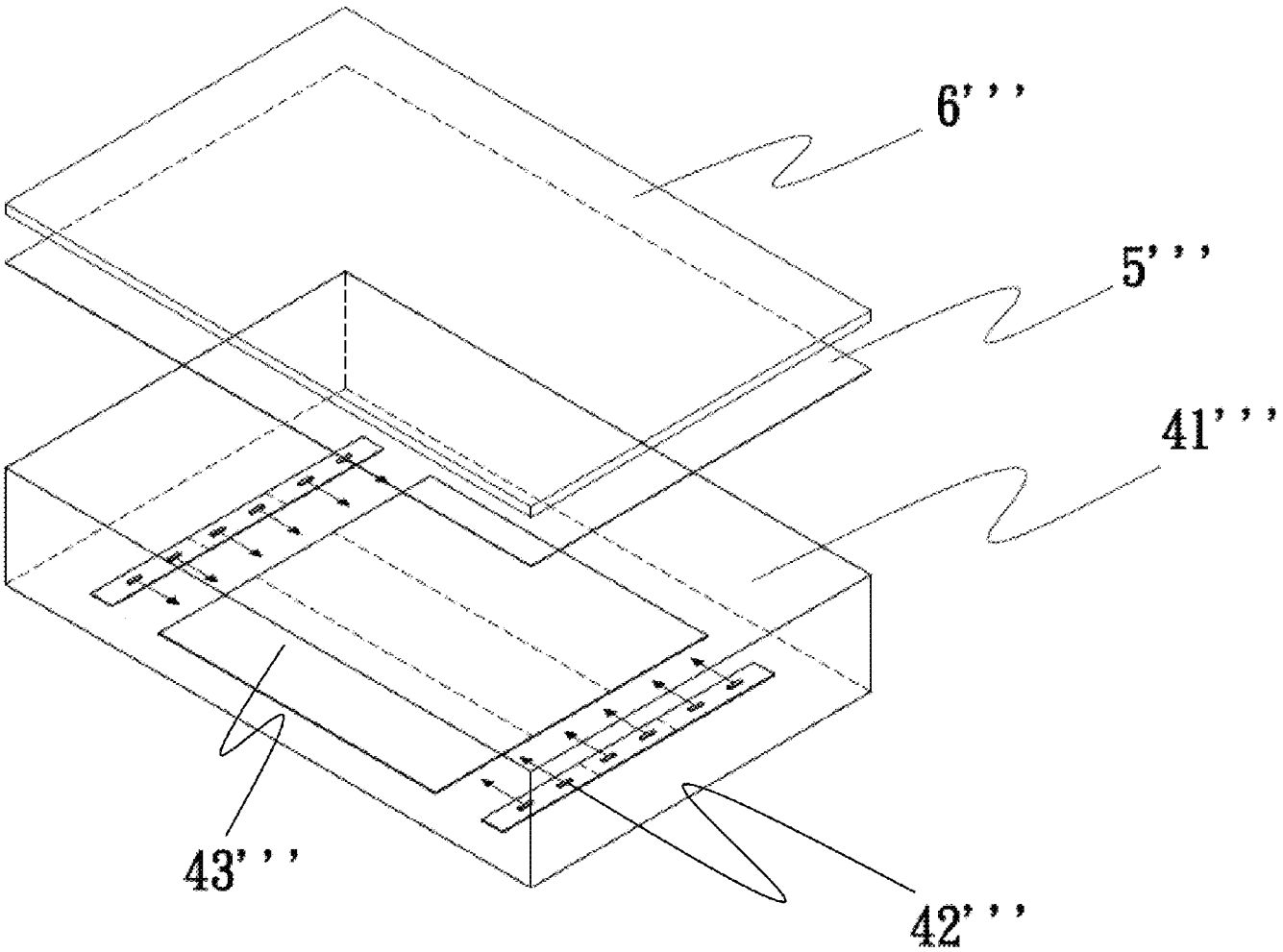
FIG. 11 is an exploded schematic diagram illustrating a liquid crystal display according to the fourth preferred embodiment of the invention.

While direct-type LEDs are used as the backlight source in the embodiments described above, it is apparent to those skilled in the art that other types of light-emitting devices may also serve as a backlight source in the invention. According to the fourth embodiment of the invention shown in FIG. 11, a backlight source including light bars of edge-type LED 41''', 42''' . . . is used in combination with a light guide 43''' for directing the light beams emitted from the LED 41''', 42''' . . . towards a color filter 5''' so as to allow the light beams entering a liquid crystal module 6'''. In this embodiment, the problem of poor brightness and chromaticity uniformity among pixels presented at cell locations in a display can still be solved successfully by virtue of the method disclosed herein.

Figure 12:
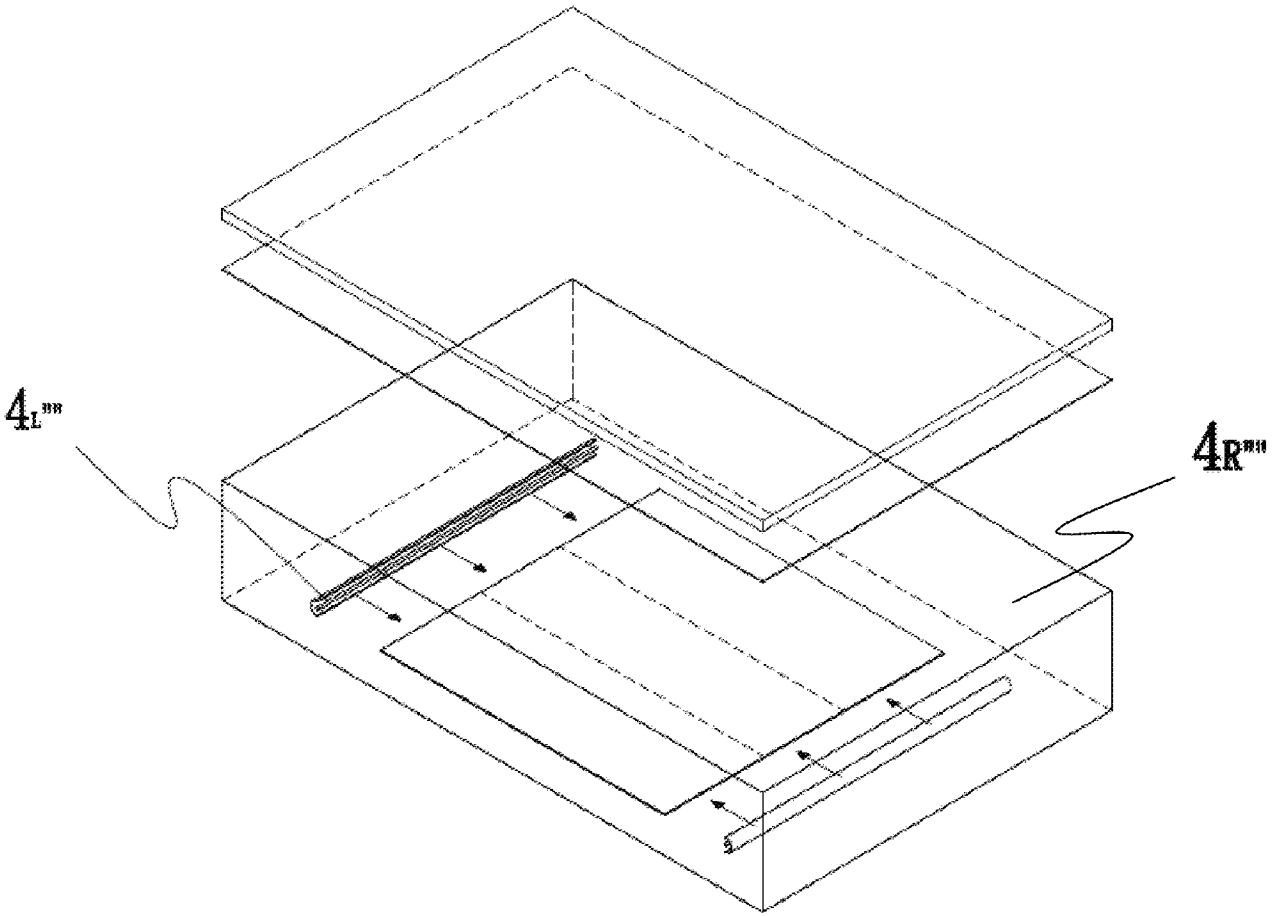
FIG. 12 is an exploded schematic diagram illustrating a liquid crystal display according to the fifth preferred embodiment of the invention.

According to the fifth embodiment of the invention shown in FIG. 12, the invention can even be applied to a backlight source including cold cathode fluorescent lamps $\mathbf{4}_L''''$ and $\mathbf{4}_R''''$. Either the poor brightness and chromaticity uniformity between the cold cathode fluorescent lamps located at both sides of the backlight, or the non-uniformity of a single cold cathode fluorescent lamp along its length, can be solved by modifying the image signal to be applied to the liquid crystal module based on the method disclosed herein.

While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the spirit and scope of the invention.

What is claimed is:

1. A method for compensating for poor uniformity of a liquid crystal display having a non-uniform backlight, where said display comprises a non-uniform backlight, a liquid crystal display module disposed at a light exit side of the backlight and including a plurality of cells with adjustable light transmission ratios for displaying a picture made up of pixels, in which the cells are divided into a plurality of adjustment regions, a control device for controlling the respective light transmission ratios of the respective cells, and a memory device for storing compensation data which enables unification of brightness and chromaticity distribution of light passing through the respective adjustment regions based on brightness and chromaticity distribution of light received by the corresponding respective adjustment regions upon receiving illumination from the backlight, said method comprising the steps of:

a) obtaining compensation data that enables adjustment of the chromaticity of the respective adjustment regions to be in accord with a virtually primary color so as to unify the brightness and chromaticity distribution of light passing through the respective adjustment regions;

b) obtaining image data of multiple image signals from an image source, with the image signals governing the respective light transmission ratios of the respective cells;

c) computing the image signals of the image data in a weighted manner based upon the compensation data in accordance with the corresponding adjustment regions, thereby providing compensated image data that includes respective compensated image signals for the respective corresponding cells; and d) determining the respective light transmission ratios of the respective cells in the liquid crystal module according to the compensated image signals;

wherein the virtually primary color is defined to have a red color component with a tri-stimulus value of ($X_{rv}Y_{rv}$, $Z_{rv}$), a green color component with a tri-stimulus value of ($X_{gv}$, $Y_{gb}$, $Z_{gv}$) and a blue color component with a tri-stimulus value of ($X_{bv}$, $Y_{bv}$, $Z_{bv}$), and wherein a given cell i of the cells is defined to present tri-stimulus values of $(X_r, Y_r, Z_r)_i$ for a red color component, $(X_g, Y_g, Z_g)_i$ for a green color component and $(X_b, Y_b, Z_b)_i$ for a blue light component as measured when corresponding liquid crystal valves are opened to have a largest light transmission ratio, and wherein the compensation data derived from a compensated image signal ($S'_r$, $S'_g$, $S'_b$) for the cell i and a corresponding image signal $(S_r, S_g, S_b)_i$ has a relationship represented by the following equation:

$$\begin{bmatrix} S'_r \\ S'_g \\ S'_b \end{bmatrix}_i = \begin{bmatrix} X_r & X_g & X_b \\ Y_r & Y_g & Y_b \\ Z_r & Z_g & Z_b \end{bmatrix}_i^{-1} \begin{bmatrix} X_{rv} & X_{gv} & X_{bv} \\ Y_{rv} & Y_{gv} & Y_{bv} \\ Z_{rv} & Z_{gv} & Z_{bv} \end{bmatrix} \begin{bmatrix} S_r \\ S_g \\ S_b \end{bmatrix}_i .$$

2. A method for compensating for poor uniformity of a liquid crystal display having a non-uniform backlight, where said display comprises a non-uniform backlight, a liquid crystal display module disposed at a light exit side of the backlight and including a plurality of cells with adjustable light transmission ratios for displaying a picture made up of pixels, in which the cells are divided into a plurality of adjustment regions, a control device for controlling the respective light transmission ratios of the respective cells, and a memory device for storing compensation data which enables unification of brightness and chromaticity distribution of light passing through the respective adjustment regions based on brightness and chromaticity distribution of light received by the corresponding respective adjustment regions upon receiving illumination from the backlight, said method comprising the steps of:

a) obtaining compensation data that enables adjustment of the chromaticity of the respective adjustment regions to be in accord with a virtually primary color so as to unify the brightness and chromaticity distribution of light passing through the respective adjustment regions;

b) obtaining image data of multiple image signals from an image source, with the image signals governing the respective light transmission ratios of the respective cells;

c) computing the image signals of the image data in a weighted manner based upon the compensation data in accordance with the corresponding adjustment regions, thereby providing compensated image data that includes respective compensated image signals for the respective corresponding cells; and d) determining the respective light transmission ratios of the respective cells in the liquid crystal module according to the compensated image signals;

wherein a common uniform chromaticity standard that all of the adjustment regions can achieve is defined to serve as the virtually primary color which has a red color component with a tri-stimulus value of $(X_{rv}, Y_{rv}, Z_{rv})$, a green color component with a tri-stimulus value of $(X_{gv}, Y_{gb}, Z_{gv})$ and a blue color component with a tri-stimulus value of $(X_{bv}, Y_{bv}, Z_{bv})$, and wherein a given cell i of the cells is defined to present tri-stimulus values of $(X_r, Y_r, Z_r)_i$ for a red color component, $(X_g, Y_g, Z_g)_i$ for a green color component and $(X_b, Y_b, Z_b)_i$ for a blue light component as measured when corresponding liquid crystal valves are opened to have a largest light transmission ratio, and wherein the compensated image signal $(S'_r, S'_g, S'_b)$ for the cell i in step b) is obtained by processing an inverse matrix of a matrix of the tri-stimulus values for the cell i $$\begin{bmatrix} X_r & X_g & X_b \\ Y_r & Y_g & Y_b \\ Z_r & Z_g & Z_b \end{bmatrix}_i^{-1}$$

and a tri-stimulus value matrix for the virtually primary color $$\begin{bmatrix} X_{rv} & X_{gv} & X_{bv} \\ Y_{rv} & Y_{gv} & Y_{bv} \\ Z_{rv} & Z_{gv} & Z_{bv} \end{bmatrix}$$

to give a transformed matrix $(M_T)_i$, and further by applying the transformed matrix $(M_T)_i$ to a corresponding original image signal $(S_r, S_g, S_b)_i$.

3. A method for compensating for poor uniformity of a liquid crystal display having a non-uniform backlight, where said display comprises a non-uniform backlight, a liquid crystal display module disposed at a light exit side of the backlight and including a plurality of cells with adjustable light transmission ratios for displaying a picture made up of pixels, in which the cells are divided into a plurality of adjustment regions, a control device for controlling the respective light transmission ratios of the respective cells, and a memory device for storing compensation data which enables unification of brightness and chromaticity distribution of light passing through the respective adjustment regions based on brightness and chromaticity distribution of light received by the corresponding respective adjustment regions upon receiving illumination from the backlight, said method comprising the steps of:

a) obtaining compensation data that enables adjustment of the chromaticity of the respective adjustment regions to be in accord with a virtually primary color so as to unify the brightness and chromaticity distribution of light passing through the respective adjustment regions;

b) obtaining image data of multiple image signals from an image source, with the image signals governing the respective light transmission ratios of the respective cells;

c) computing the image signals of the image data in a weighted manner based upon the compensation data in accordance with the corresponding adjustment regions, thereby providing compensated image data that includes respective compensated image signals for the respective corresponding cells; and d) determining the respective light transmission ratios of the respective cells in the liquid crystal module according to the compensated image signals;

wherein when defining that a given adjustment region k of the adjustment regions in the backlight has a brightness control value of $\alpha_k$, and that an original image signal for a cell i of the cells is $(S_r, S_g, S_b)_i$ and that the adjustment region k presents a tri-stimulus value matrix $M_k$, and that the adjustment region k provides illumination to the cell i with an illumination coefficient $\lambda_{ik}$, and that a common uniform chromaticity standard that all of the adjustment regions can achieve serves as the virtually primary color having a tri-stimulus value matrix $M_v$ for red, green and blue color components, a compensated image signal $(S'_r, S'_g, S'_{b-i}$ for the cell i is obtained by the following equation:

$$\begin{pmatrix} S'_r \\ S'_g \\ S'_b \end{pmatrix}_i = \left( \sum_{k=j}^{j+m} \lambda_{ik} \alpha_k M_v^{-1} M_k \right)^{-1} \begin{pmatrix} S_r \\ S_g \\ S_b \end{pmatrix}_i$$

wherein adjustment regions j, j+1, . . . j+m represent the adjustment regions having a predetermined criticality to the cell i.

* * * * *